United States Patent [19]

La Mers

[11] 4,303,461

[45] * Dec. 1, 1981

[54] LABELLING SYSTEM

[75] Inventor: Herbert La Mers, Oxnard, Calif.

[73] Assignee: Gar Doc, Incorporated, Milford, N.H.

[ * ] Notice: The portion of the term of this patent subsequent to Aug. 12, 1997, has been disclaimed.

[21] Appl. No.: 138,586

[22] Filed: Apr. 8, 1980

Related U.S. Application Data

[63] Continuation-in-part of Ser. No. 866,455, Jan. 3, 1978, Pat. No. 4,217,164, which is a continuation of Ser. No. 618,690, Oct. 1, 1975, abandoned.

[51] Int. Cl.[3] ..... B65C 9/18

[52] U.S. Cl. ..... 156/361; 156/495; 156/541; 156/542; 156/584; 156/DIG. 33; 156/DIG.42

[58] Field of Search ..... 156/584, 541, 542, 540, 156/249, 344, 495, DIG. 33, DIG. 42, 361

[56] References Cited

U.S. PATENT DOCUMENTS

| | | | |
|---|---|---|---|
| 2,276,297 | 3/1942 | Flood | 242/67.3 R |
| 2,303,346 | 12/1942 | Flood | 156/267 |
| 2,304,787 | 12/1942 | Avery | 156/584 |
| 2,317,576 | 4/1943 | Avery | 156/584 |
| 2,331,019 | 10/1943 | Flood | 156/DIG. 48 |
| 2,364,607 | 12/1944 | Dreher | 40/2 R |
| 2,765,205 | 10/1956 | Capella et al. | 156/584 |
| 3,075,569 | 1/1963 | Blumberg et al. | 156/541 |
| 3,483,063 | 12/1969 | Baines et al. | 156/542 |
| 3,526,189 | 9/1970 | Allen | 156/384 |
| 3,736,208 | 5/1973 | Kraft et al. | 156/541 |
| 3,738,888 | 6/1973 | Williams | 156/541 |
| 3,816,210 | 6/1974 | Aoko et al. | 156/361 |
| 3,891,492 | 6/1975 | Watson | 156/361 |
| 3,938,698 | 2/1976 | McDavid, Jr. et al. | 156/541 |
| 3,992,244 | 11/1976 | Craig et al. | 156/541 |
| 4,019,935 | 4/1977 | Harvey | 156/361 |
| 4,132,583 | 1/1979 | Hodgson | 156/361 |
| 4,217,164 | 8/1980 | LaMers | 156/541 |

*Primary Examiner*—Michael G. Wityshyn
*Attorney, Agent, or Firm*—John C. Fox

[57] ABSTRACT

Apparatus for automatically sequentially applying labels to objects characterized by a plate having an edge defining a V shaped region. A strip transport means moves a label strip comprised of first and second parallel carrier strip portions, having labels adhered thereto bridging said portions, along the upper surface of the plate toward the apex of the V shaped region. The strip transport means then pulls the two carrier strip portions in diverging directions around the edge portions of the V shaped region to thus release the label bridging the carrier strip portions at that point. The label strip has index marks therealong which cooperate with the strip transport means to prevent any cumulative differential linear movement between the carrier strip portions. The index marks comprise points on the strip whose physical characteristics, such as optical, magnetic, electrical or structural enable the marks to be readily distinguished by a sensor from other areas on the strip.

18 Claims, 20 Drawing Figures

VACUUM
AIR PRESSURE
91
152
150
92
94
96
82
98
102
52
160
158
156
103
100
54
154
80
130
140
138
147
72
70
85g
78g
85
78
81
90
74
87
89
83
78

LABELLING SYSTEM

RELATED APPLICATIONS

This application is a continuation-in-part of application 866,455 filed Jan. 3, 1978 now U.S. Pat. No. 4,217,164 which in turn is a continuation of application Ser. No. 618,690 filed Oct. 1, 1975 now abandoned.

BACKGROUND OF THE INVENTION

Applicant's parent application discloses an apparatus for automatically sequentially applying labels to objects. The apparatus is characterized by a plate having an edge defining a V shaped region. A strip transport means moves a label strip comprised of first and second parallel carrier strip portions, having labels adhered thereto bridging said portions, along the upper surface of the plate toward the apex of the V shaped region. The strip transport means then pulls the two carrier strip portions in diverging directions around the edge portions of the V shaped region to thus release the label bridging the carrier strip portions at that point. A label applying means engages each label immediately adjacent to the V shaped region and presses the label against the objects to be labeled.

The apparatus disclosed in the parent application is further characterized by the use of a label strip having index marks therealong which cooperate with the strip transport means to prevent any cumulative differential linear movement between the carrier strip portions. In the preferred embodiments disclosed in the parent application, the index marks comprise sprocket holes formed in the label strip which are engaged by drive sprockets in the strip transport means.

The present invention is directed to further embodiments of applicant's apparatus for automatically sequentially applying labels to objects, utilizing alternative means for driving said label strip and for preventing cumulative differential linear movement between the carrier strip portions of the label strip.

SUMMARY OF THE INVENTION

In accordance with the present invention, the index marks carried by the label strip are defined by distinguishable characteristics which can be readily sensed. For example, the index marks can comprise points on the strip where physical characteristics, such as optical, magnetic, electrical or structural, enable the marks to be readily distinguished from other areas on the strip.

In a first embodiment disclosed herein, uniformly spaced index marks are provided on both carrier strip portions and separate sensors are located downpath from the V shaped region to monitor the linear movement of both carrier strip portions.

Control circuitry responds to the index marks sensed by the sensors to prevent any cumulative differential linear movement between the carrier strip portions.

In a second embodiment, a single sensor up-path from the V shaped region senses the index marks. When a predetermined length of the label strip moves past the sensor, the torque on the strip transport means downpath drive wheels is made to be insufficient to overcome drag imposed on the entire label strip but sufficient to pull out any slack in either carrier strip portion.

The novel features of the invention are set forth with particularity in the appended claims. The invention will best be understood from the following description when read in conjunction with the accompanying drawing.

DETAILED DESCRIPTION

FIGS. 1–15 hereof are identical to the correspondingly numbered figures in applicant's parent application Ser. No. 866,455 and are repeated here to facilitate an understanding of the context of applicant's embodiments disclosed in FIGS. 16–19 hereof.

Although only FIGS. 1–15 and the supporting text of the parent application have been expressly included herein, it is intended that the entire parent application be incorporated herein by reference.

Figure 1:
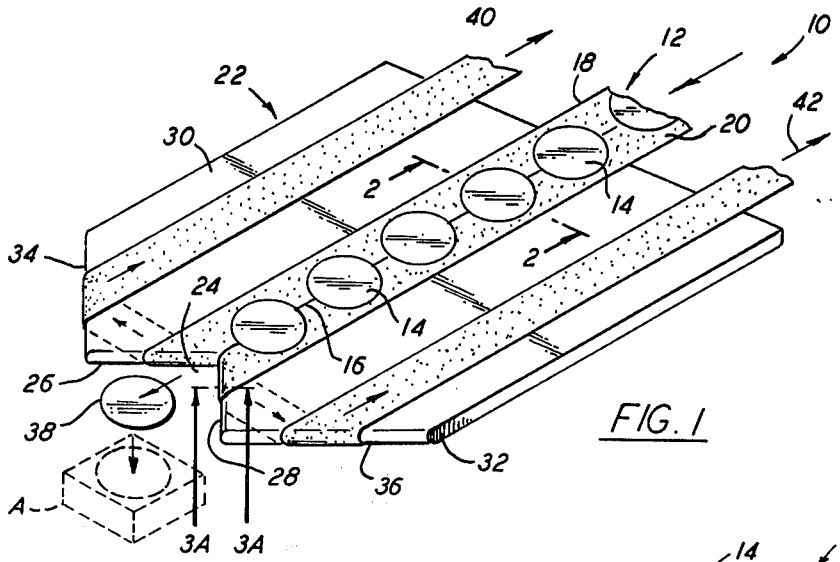
FIG. 1 is a partial perspective view of a labelling system as disclosed in applicant's aforementioned parent application.
Figure 3A:
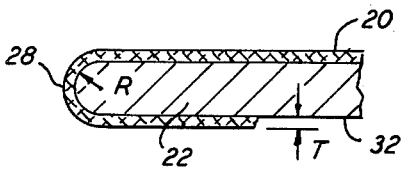
FIG. 3A is a sectional view taken along the plane 3A—3A of FIG. 1.
Figure 2:
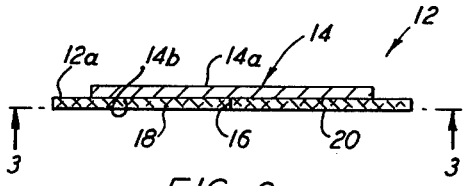
FIG. 2 is a sectional view taken along the plane 2—2 of FIG. 1.
Figure 3:
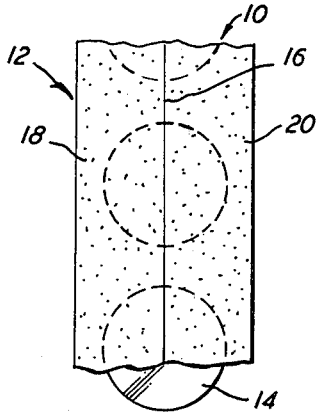
FIG. 3 is a sectional view taken along the plane 3—3 of FIG. 2.

FIGS. 1–3 illustrate details of a label carrying arrangement 10 of the invention, which includes an elongated backing web or carrier strip 12 and a multiplicity of labels 14 spaced along the length of the carrier strip. Each of the labels 14 has a front face **14*a* with a decorative design or other marking printed thereon, and a rear face 14*b* with contact adhesive thereon. The carrier strip has a front face 12*a* with release coating, such as silicone, which facilitates stripping of the label adhesive from the carrier strip. The carrier strip 12 includes a separation line 16 extending along its length at a middle portion thereof, to divide the carrier strip into two carrier strip portions 18, 20 that support different portions of the label 14**.

Apparatus shown in FIG. 1 for stripping the labels 14 from the carrier strip 12 includes a label stripper or separator in the form of a plate 22 having a substantially V-shaped edge region or notch 24 which forms a pair of separator edges 26, 28. The carrier strip with the labels thereon initially moves along an upper face 30 of the label separator towards the V-shaped edge portion or region 24, with the separation line 16 aligned with the apex of the V. Each of the carrier strip portions 18, 20 extends around a different one of the separator edges 26, 28, so that the carrier strip is pulled apart thereat. The strip portion 18 which extends around the separator edge 26, moves along the underside or lower face 32 of the plate, extends around an auxiliary guide edge 34, and then extends along the upper face 30 of the separator plate. The other carrier strip portion 20 extends in a corresponding manner, around the separator edge 28, around another auxiliary guide edge 36, and then along the upper face of the separator plate. It can be seen that as each label 14 moves into the V-shaped region 24, the two carrier strip portions 18, 20 are directed downwardly and apart from each other, so that the label tends to continue to move in the direction of arrow 38. As shown in FIG. 3A, the radius of curvature R of each edge, such as 28, need not be sharp. Instead, the radius R is greater than the thickness T of the carrier strip, which minimizes the possibility of tearing the carrier strip. If desired, the separator edges need not be stationary but may be rollers of suitable diameter.

In order to advance the label carrying arrangement 10, it is necessary only to pull the two carrier strip portions 18, 20 along the paths of the arrows 40, 42. The labels 14 on the carrier strip 12 will then move beyond the V-shaped edge region 24 and become separated from the carrier strip. Of course, in order to apply the labels to articles indicated at A, it is necessary to provide a means for reliably moving the freed labels against the articles. A labelling machine, to be described below, provides a plunger which engages the labels and reliably applies them to the goods.

FIGS. 4–9 illustrate details of a labelling machine 50 which moves the label strip 10 to apply the labels 14 thereon against articles A. The labelling machine 50 includes a frame 52 with an upstanding center wall 54, a label guiding and moving apparatus 56 on the first side of the upstanding wall 54, and drive and control apparatus 58 on the other side of the upstanding wall. The label guiding and moving apparatus 56 includes a supply reel 60 rotatably mounted on the frame and carrying a roll of the label strip 10. The label is guided from the reel 60 around a guide roll 62 and past a spring strip 63, around a feed roll 64, and along the upper side of the separator plate 22 towards the V-shaped edge region 24 thereof. The two carrier strip portions 18, 20 which have been separated at the V-shaped edge region 24, are pulled along their respective paths by a pair of tensioning rollers 66, 68. After passing through the tensioning rollers 66, 68, the two carrier strip portions 18, 20 may be directed into a bin for later disposal.

Figures 7, 8:
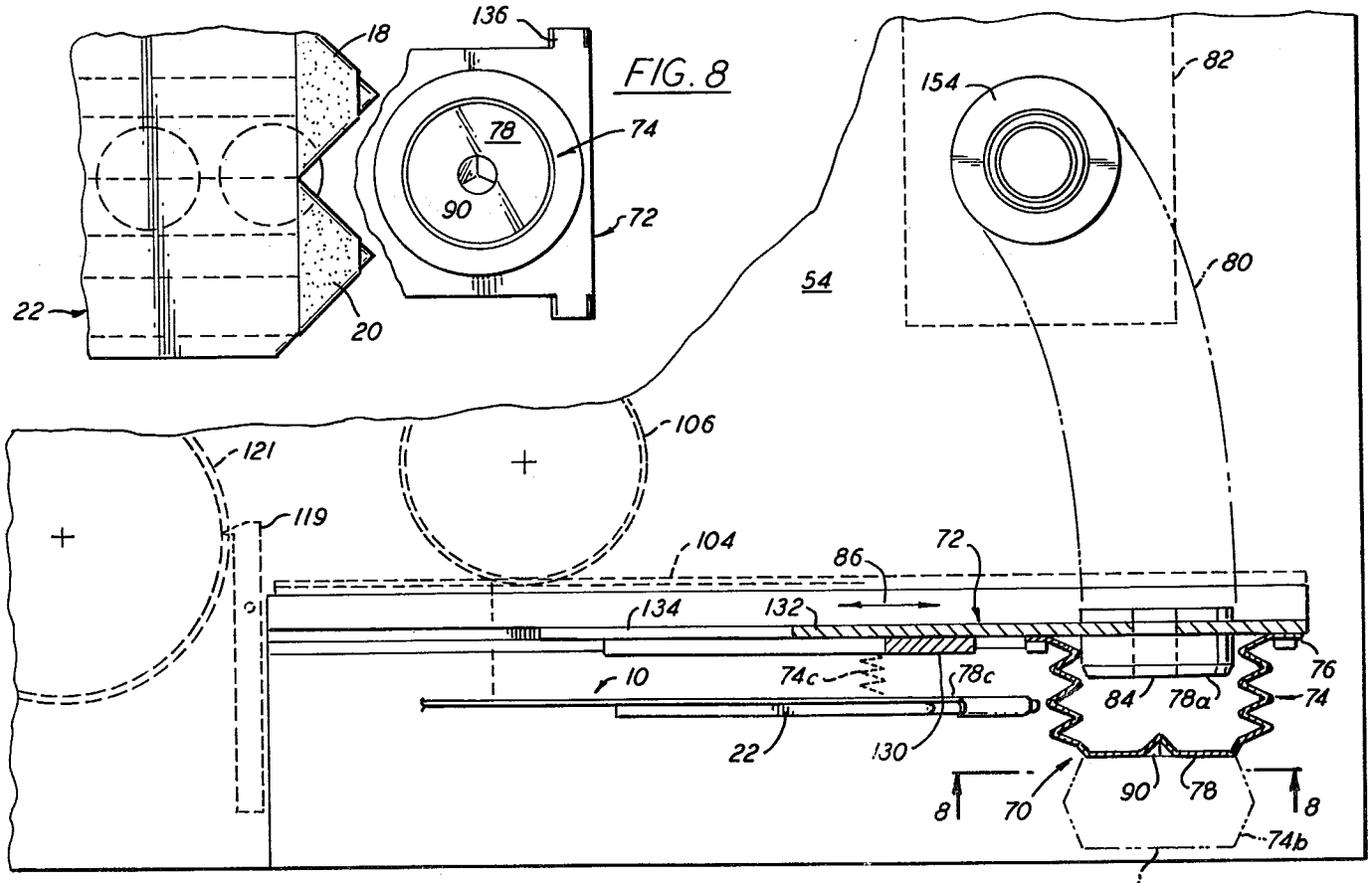
FIG. 7 is a partially sectional side view of a system of FIG. 4.
FIG. 8 is a sectional view taken substantially along the plane 8—8 of FIG. 7.

A plunger apparatus 70 which is disposed near the V-shaped region 24 of the separator plate, serves to engage each label before, during, and after its separation from the carrier strip, and to carry that label against an article A, so that the adhesive-bearing face of the label is pressed against the article. The articles are carried on a conveyor apparatus C past the labelling machine, and movement of the plunger 70 is timed so that a label is applied to each article passing thereby. As illustrated in FIG. 7, the plunger apparatus 70 includes a plunger or bellows supporting plate 72 and a bellows 74 with an inner portion 76 fixed to the plunger supporting plate and an outer end face 78. A flexible hose 80 extends from a pressure control 82 to a tubular coupling 84 which opens to the inside of the bellows 74. The pressure control 82 can supply a low pressure which is less than atmospheric, or vacuum, through the tube 80 to the bellows 74 to contract the bellows from the relaxed position shown at 74 to a contracted position wherein its end face is at **78*a*. Alternatively, pressure control 82 can supply pressured air through the hose 80 to the bellows 74 to expand the bellows to the configuration indicated at 74*b* wherein the end face has been thrust out to the position 78*b*. When a label lies against the end face 78 and air pressure is applied to the bellows, its end face 78** pushes the label against an article.

The bellows support plate 72 can move substantially longitudinally as indicated by arrows 86. Thus, the plate 72 can move the bellows 74, in its contracted position, rearwardly to the position indicated at **74*c* wherein the face of the bellows at 78*c* lies over the next label to be separated from the backing strip. Thereafter, the bellows support plate moves down so the bellows engages a label, and the support plate advances the bellows 74 in synchronism with advancement of the label strip 10 so that the bellows face 78 moves with the label while the label is being completely separated from its carrier strip. The bellows is then extended towards the position 746** to press the label against an article that is to be labelled.

In order to securely hold a label against the bellows face 78 prior to applying the label to an article, and to then reject the label from the bellows face as the bellows withdraws from the article, the bellows face 78 is provided with slits that form a hole 90, as shown in FIG. 8. The hole permits a low rate of air movement through the face into the bellows, when a vacuum has been applied through the tube 80 to the bellows. A vacuum is applied to the bellows to hold it in a contracted state while it is first pressed against a label at the position **74*c* in FIG. 7. The vacuum continues to be applied while the bellows moves with the label as the label separates from carrier strip and passes off the V-shaped edge of the separator plate 22. The vacuum not only keeps the bellows contracted, but also serves to hold the label firmly against the face of the bellows. When the bellows lies opposite the article to be labelled, pressured gas such as air is suddenly applied to the bellows. The pressured air causes the bellows to expand towards the configuration 74*b*** to press against the article.

For the application of thin flexible labels, and where precise location of the label on the article is not important, the hole 90 is formed so that some air leaks out. The pressured air tends to reject the label from the face 78 of the bellows, but it does not matter if the label flies off the bellows even as it is moving towards the article if the distance to the article is not great. The pressured air rejection of the label helps in preventing the label from sticking to the bellows as the bellows contracts and draws away from the article. The bellows normally begins to withdraw from the article as the pressure therein is reduced but is still at a substantial level, inasmuch as the completely unpressured bellows tends to assume a configuration wherein its face is at 78 when pressure in the bellows reaches the atmospheric value.

Figures 9, 12, 13:
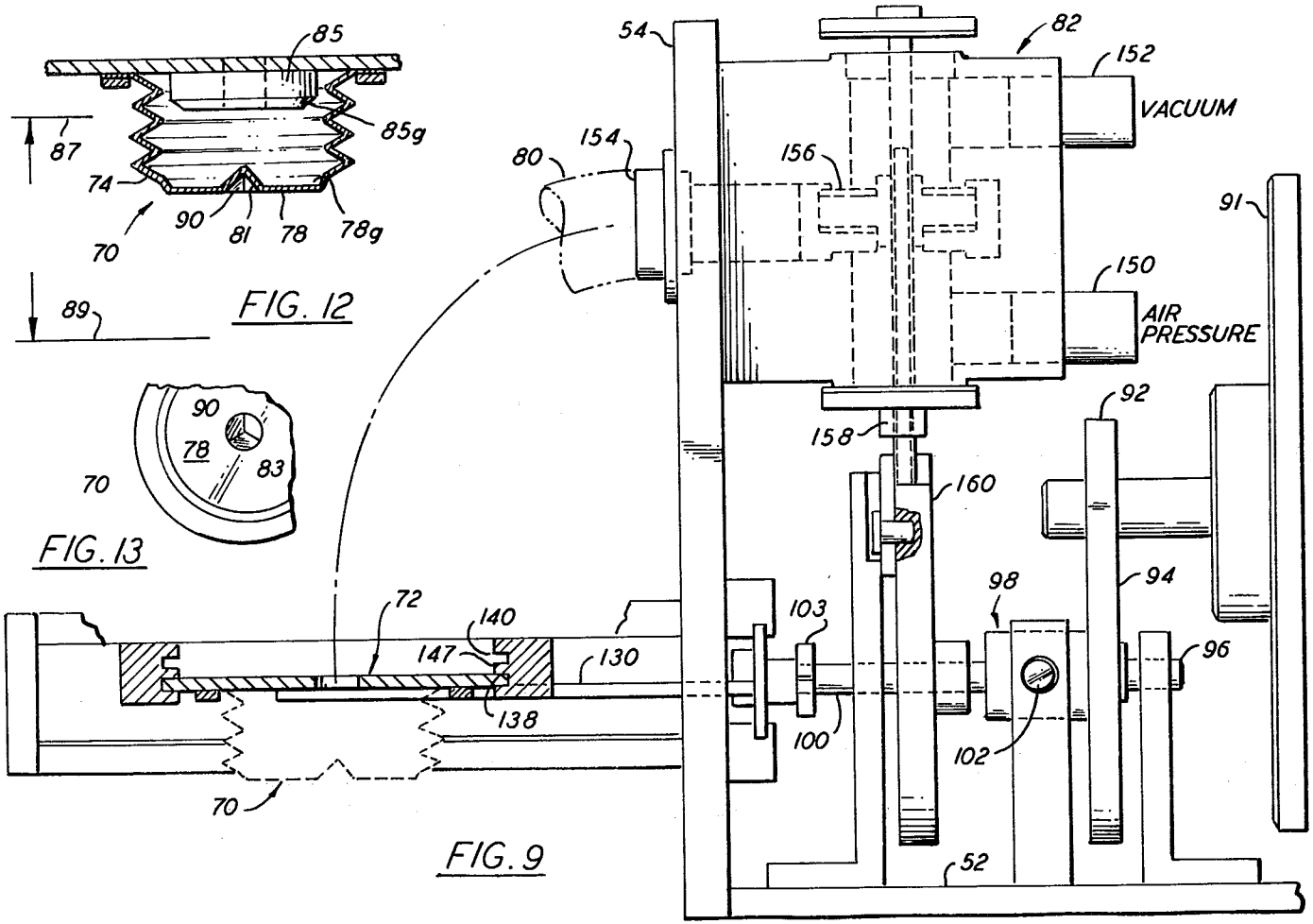
FIG. 9 is a front elevational view of the system of FIG. 4.
FIG. 12 is a sectional front view showing the details of the bellows of FIG. 9.
FIG. 13 is a bottom view of the bellows of FIG. 12.

FIG. 12 illustrates the shape of the bellows 74 in its relaxed state. The bellows is molded of elastomeric material, with a recess 81 in the bellows face, and with three slits cut into the recessed portion to form the hole 90. The recess forms three flaps 83 which can readily bend inwardly but not outwardly. Accordingly, when a vacuum is applied to the bellows, air can pass into the bellows through the hole 90. However, when pressured air is applied inside the bellows, the flaps 83 tend to press against one another to close the hole and minimize the escape of air from the bellows. The flaps 83 therefore form a check valve which couples the face of the bellows to the inside thereof, to allow air flow substantially only in a direction into the bellows.

When the bellows contracts, the inside of the bellows end contacts a substantially rigid internal member 85 that limits the contraction of the bellows. The internal member 85 has a guide surface **85*g* which engages a correspondingly shaped surface 78*g* of the bellows end to not only limit the longitudinal contraction of the bellows end, but also to laterally position it. As a result, the bellows begins each expression from the same lateral position and orientation. This results in the bellows tending to extend along the same path each time, to provide greater accuracy in the positioning of the labels on the articles. When the bellows is contracted, its end face lies at the plane 87, while when fully extended without an article in the way the bellows can expand to the plane 89. Normally, an article is positioned about three quarters of the distance from the plane 87 to the plane 89**. In examining causes for erratic directions of bellows expansion, it has been found that one cause is that the folds of the bellows may tend to stick to one another when compressed during the application of vacuum in the bellows. When the bellows begins expanding, locations which tended to stick together, tend to resist extension and the bellows tends to curve as it expands. It has been found that the application of release powder such as is used in plastic injection molding, eliminates the sticking problem, the powder being applied to both the inside and outside of the bellows fold. It has been found that the release powder remains in place during long continuous use of the bellows.

Figure 5:
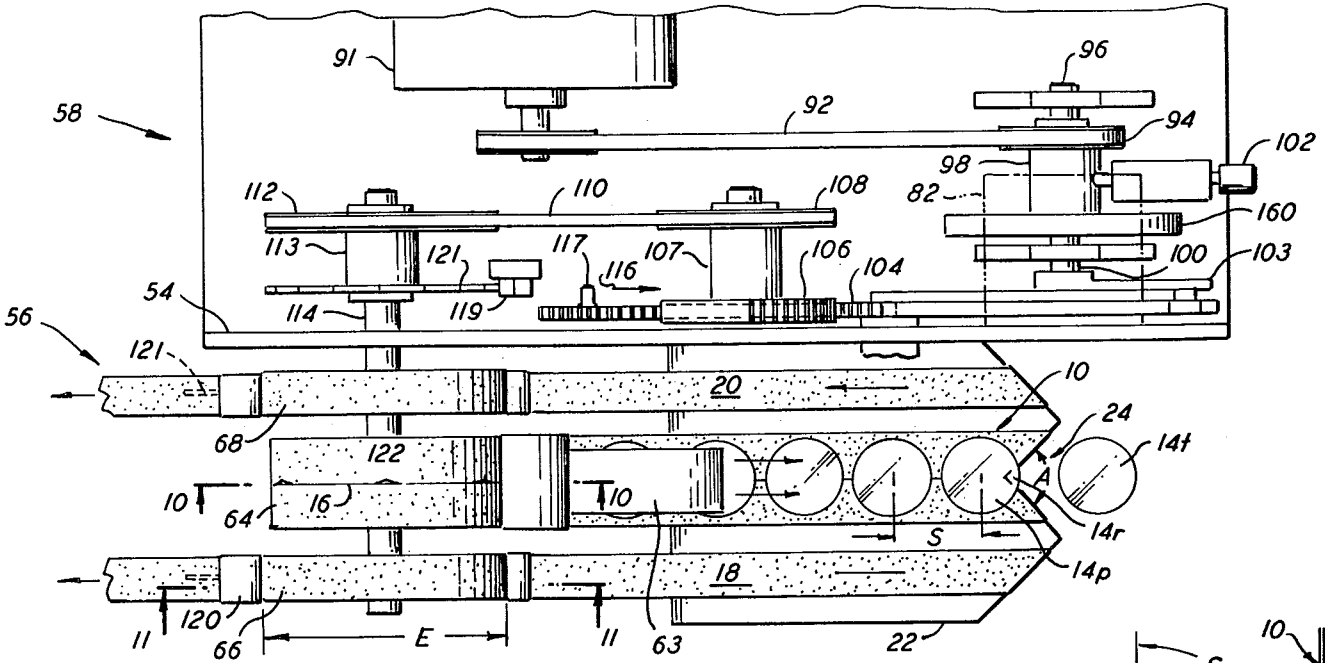
FIG. 5 is a partially sectional plan view of the system of FIG. 4.

As illustrated in FIGS. 5 and 9, the means for transporting the label carrying strip includes a motor 91 which is coupled through a belt 92 to a pulley 94. The pulley shaft 96 is coupled through a single cycle clutch 98 to a drive shaft 100. The single cycle clutch 98 merely permits operation of the machine one cycle at a time, the drive shaft 100 rotating only one revolution each time a pin 102 is pulled out and released, but the shaft 100 rotating continuously if the pin 102 is retained in a pulled-out condition. The drive shaft 100 rotates a crank 103 that drives a rack or slide 104 back and forth. The slide 104 has gear teeth engaged with a gear 106 that is coupled through an overrunning clutch 107 to a sprocket wheel 108, so that the sprocket wheel 108 turns in only one direction. This sprocket wheel 108 is coupled by a timing belt 110 to another sprocket wheel 112 which drives another single cycle clutch 113. The single cycle clutch drives a toothed wheel 121 and a feed shaft 114. The feed roll 64, which pulls the label strip 10 off the supply reel, is fixed to and driven by the feed shaft 114. The single cycle clutch is enabled to turn the feed shaft when a pin 117 on the slide 104 hits a pawl 119 to pivot the pawl out of engagement with the toothed wheel 121 on the feed shaft, which releases the single cycle clutch for turning the feed shaft 114. Thus, the feed roll 64 cannot turn until a predetermined time in each cycle. The feed roll can then rotate just enought to advance the label strip 10 by a distance S equal to the center-to-center distance of the labels along the strip. The slide 104, at that time, will have moved pin 117 out of engagement with the pawl 119, which stops further rotation of the wheel 121 and feed shaft 114.

Figure 11:
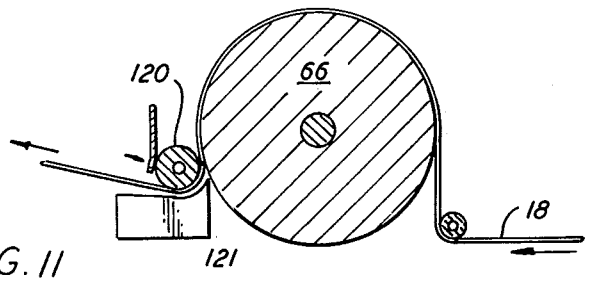
FIG. 11 is a sectional view taken along the plane 11—11 of FIG. 5.

The two tensioning rollers 66, 68 which pull the carrier strip portions, are fixed to the same feed shaft 114 to which the feed roll 64 is fixed. Therefore, as the feed roll 64 feeds the label strip 10 towards the V-shaped region 24 where the labels are separated from the carrier strip, the tensioning rolls 66, 68 turn in unison to pull the carrier strip portions 18, 20 to thereby pull the label strip over the edges of the notch 24. In order to assure tension in the carrier strip portions 18, 20, the two tensioning rollers 66, 68 are constructed with a diameter E slightly larger than the diameter of the feed roll 64, resulting in the surfaces of the tensioning rolls 66, 68 turning slightly faster than the surface of the feed rolls 64. The tension rolls 66, 68 are in the form of rubber tires that permit slippage of the carrier strip portions 18, 20 thereon, so that the strip portions are pulled to maintain tension but are not pulled so hard as to tear them. As shown in FIG. 11, backing rolls 120 are provided to press the carrier strip portions such as 18 against a corresponding tensioning roller 66. Also, a stripper blade 121 is provided that extends into a groove of the tensioning roller to insure separation of the carrier strip portions from roller 66. An alternative arrangement would be to put sprockets on the tensioning rollers engaging slits 226 and omit them on feed roller 64.

Figure 10:
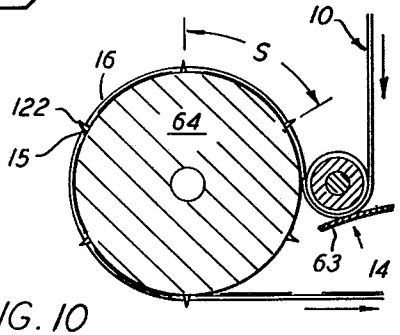
FIG. 10 is a sectional view taken along the plane 10—10 of FIG. 5.

In order for the labelling machine to operate properly, it is necessary to prevent differential linear movement between the carrier strip portions 18, 20 and assure synchronicity between the label strip movement and the bellows operation. This is accomplished, as will be discussed hereinafter, by providing index marks, in the form of sprocket holes, in the label strip which cooperate with sprockets 122 on the strip transport means, e.g. on the feed roll 64. As shown in FIGS. 5 and 10, the sprockets 122 are spaced about the feed roll by the distance S between the labels, and are designed to fit into the separation line 16 between the carrier strip portions and into the space or gap 15 between the labels. Thus, the label strip, as represented in FIG. 5, forms its own sprocket holes at gaps 15 which are engaged by sprockets 122 to control the positions of the labels in the machine. It may be noted that these sprocket holes at the gaps 15 between adjacent labels, arise automatically in the production of the label carrying arrangement, and it is not necessary to form special sprocket holes along edges of the backing strip to enable control of label position in the machine. Additional sprocket holes can be provided, however, to avoid contact of labels with sprockets.

Figure 6:
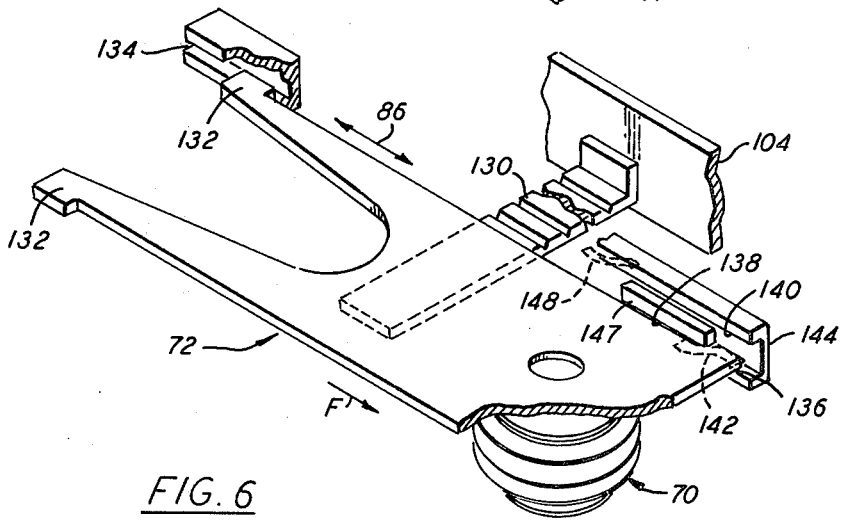
FIG. 6 is a partial perspective view of the apparatus of FIG. 4, showing details of the label applying means.

As shown in FIGS. 6 and 7, the plunger apparatus 70 is moved back and forth by a tow bar 130 which has an inner end fixed to the slide 104 and an outer end fixed to the bellows-supporting plate 72. Although the primary motion of the bellows-supporting plate 72 is back and forth in the direction of arrows 86, it is also necessary to raise the forward end of the plate 72 which holds the bellows 74 during rearward motion of the bellows. This is to prevent the bellows from rubbing on the label strip during such rearward motion. The support plate 72 is guided by a pair of rearward tabs 132 which can move back and forth in guide slots 134 formed in guide ways 144 on the machine frame, while the front of the plate has a pair of tabs 136 which can move along either of two guide slots 138, 140 that are separated by a divider 147. When the support plate 72 moves slightly forward, in the direction of arrow F, from the position shown in FIG. 6, each of its forward tabs 136 which has been moving along the lower slot 138, becomes free to move up towards the level of upper slot 140. A forward spring 142 disposed along each of the guide ways 144, urges each tab 136 to move up, so that when the slide 72 moves rearwardly its tabs 136 slide at a higher level. As a result, the contracted bellows of the plunger apparatus 70 can move rearwardly to a position over a next label (14*p* in FIG. 5) to be applied, without rubbing against the label strip. As the forward tabs 136 approach their rearward position, they pass rearward of the divider 147 that separates the upper and lower slots, and also pass under a rearward spring 148 that urges the tabs 136 downwardly. The tow bar 130 which moves the support plates 72 back and forth, has a series of slots cut into it, to provide increased flexibility, to permit the front portion of the support plate to move up and down a small distance as it moves back and forth.

The use of apparatus to move the label a distance beyond the separator edges before thrusting the label towards an article, avoids "hinging" of the label. Hinging is the phenomenon of the rear end of the label tending to stick to the separation edge or carrier strip, and therefore to tend to resist movement against an article to be labelled.

As described above, the application of vacuum and pressured air to the bellows through the hose 80 is controlled by the pressure control 82. As illustrated in FIG. 9, the pressure control 82 includes an air pressure inlet 150 through which pressured air is constantly applied, a vacuum inlet 152 to which a vacuum is constantly applied, and an outlet 154 which is coupled to the hose 80. A valve member 156 can move up and down to alternately couple the outlet 154 to either the air inlet 150 or the vacuum inlet 152. A rod 158 fixed to the valve member 156, is moved up and down by a cam 160 that is fixed to the drive shaft 100. The cam 160 is configured so that a vacuum is applied to the pressure control outlet 154 during the time when the bellows engages a label and moves with the label to a position opposite the article to be labelled. The cam is configured to then operate the valve member 156 so that pressured air is applied to the bellows to extend it briefly, near the end of its forward travel after which the vacuum is again applied to the pressure control outlet.

Figure 14:
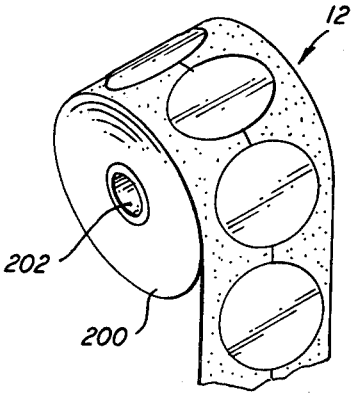
FIG. 14 is a perspective view of a label strip in the form of a roll.
Figure 15:
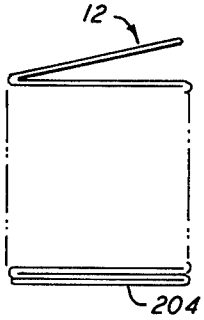
FIG. 15 is a front elevation view of the label strip in fan-folded form.
Figure 4:
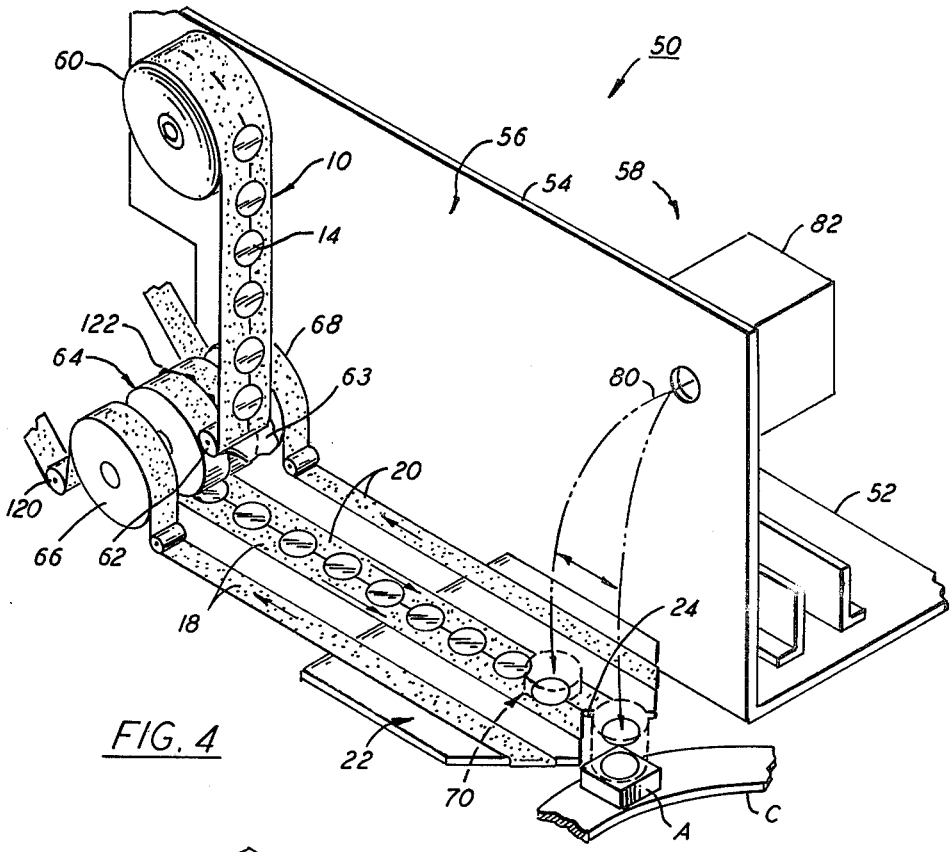
FIG. 4 is a more complete perspective view of the labelling system of FIG. 1.

The label strip can be provided in different forms. As illustrated in FIG. 14, the label strip 10 can be provided as a roll 200 of many turns with a cardboard tube 202 at the center that fits onto a shaft of the labelling machine. FIG. 15 illustrates a fan-folded arrangement 204 of the labelling strip 12, which is used for producing computer printed labels.

Figure 16:
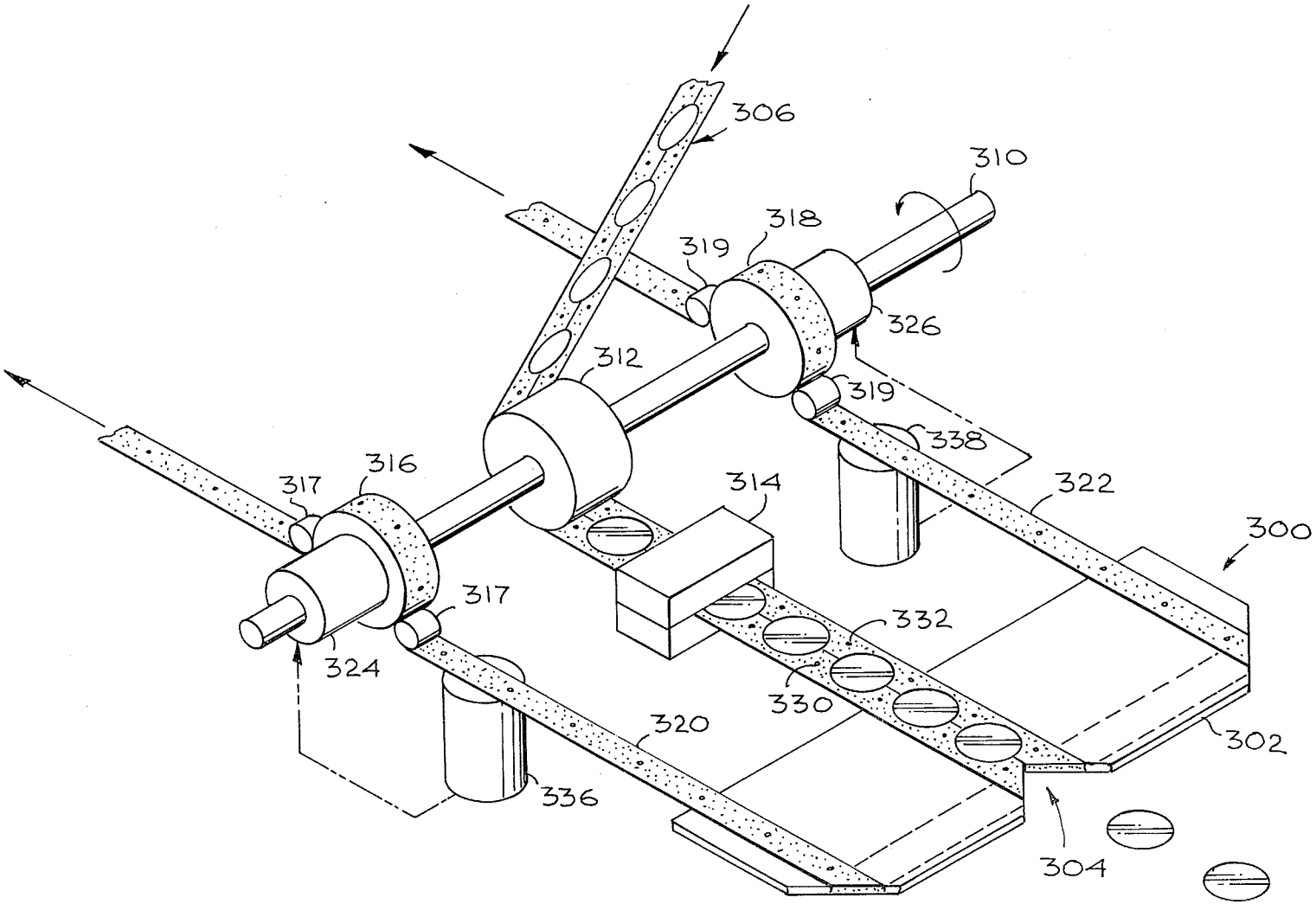
FIG. 16 is a perspective view of an alternate label applying apparatus in accordance with the present invention.
Figure 17:
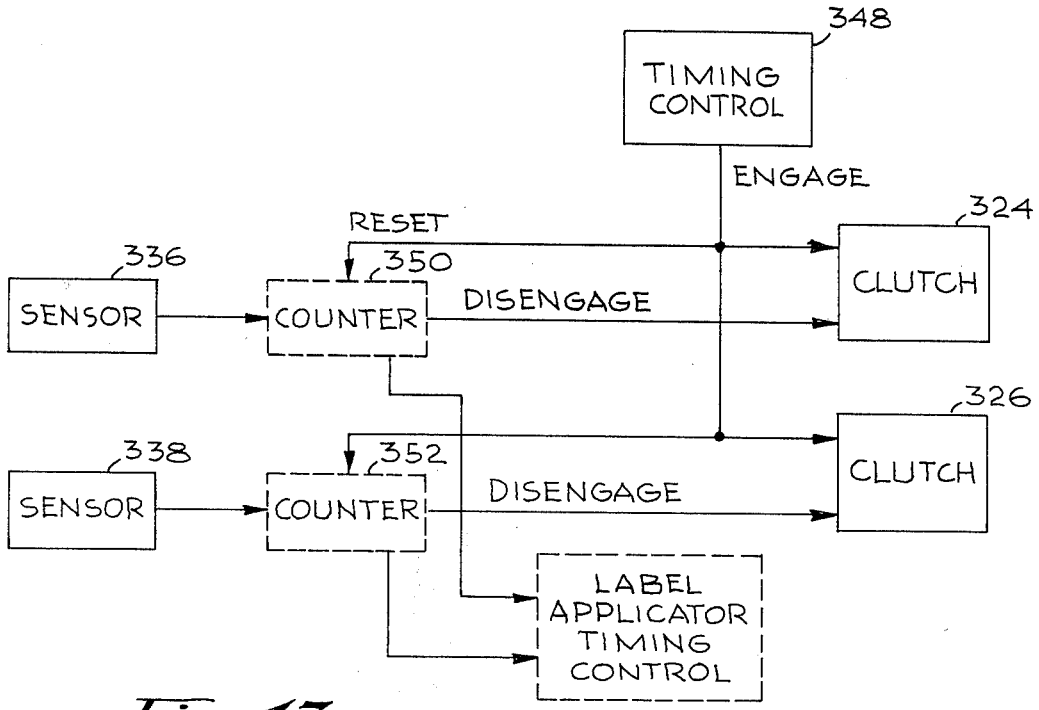
FIG. 17 is a block diagram of a control circuit usable with the embodiment of FIG. 16.

FIG. 1–15 discussed thus far are common to applicants parent application and disclose an apparatus in which the label strip carries index marks in the form of sprocket holes which are engaged by sprockets on the strip transport means to prevent differential linear movement between the carrier strip portions and assure synchronicity between label strip movement and bellows operation. Attention is now directed to FIGS. 16 and 17 which illustrate a first alternative embodiment and FIGS. 18 and 19 which illustrate a second alternative embodiment, both embodiments employing label strips having index mark comprising points which can be sensed based on their distinguishable physical characteristics such as optical, magnetic, electrical or structural. Indeed, the index marks can comprise a part of the labels themselves such as the leading or trailing edge, or a printed character thereon. Alternatively, the index marks can be formed on the carrier strip portions. Attention is now directed to FIG. 16 which illustrates a fist alternative embodiment of automatic label applying apparatus in accordance with the present invention. The apparatus of FIG. 16 is similar to the apparatus thus far described to the extent that it includes a plate 300 having a plate edge 302 including a V-shaped region 304. A strip transport means is also provided for moving a label strip 306 along a path extending substantially contiguous with the upper surface of the plate 300 toward the apex of the V-shaped region 304 and then along first and second branch paths respectively extending around first and second edge portions of the V-shaped region and thence in diverging directions adjacent the lower surface of the plate 300.

The strip transort means of FIG. 16 includes a shaft 310 which is driven by a motor (not shown). The shaft 310 carries a guide roller 312 located up-path from the V-shaped region 304. The label strip 306 extends around the guide roller 312 and thence through a suitable mechanical drag means 314. The strip transport means further includes first and second drive rollers 316 and 318 (each having nip rollers 317 and 319 associated therewith), located downpath from the V-shaped region 304, respectively engaged with first and second carrier strip portions 320 and 322. Electrically actuable clutch assemblies 324 and 326 are respectively associated with drive rollers 316 and 318. When the clutch assemblies are engaged, the respective drive roller is coupled to and rotates with the shaft 310. Disengagement of the clutch assemblies decouples the drive rollers from the shaft 310.

Whereas the apparatus disclosed in FIG. 1–15 utilizes a label strip having sprocket holes therein engaged with a sprocketed member of the strip transport means in order to prevent cumulative differential linear movement of the two carrier strip portions and assure synchronicity between the label strip movement and the label applicator operation, the embodiment of FIG. 16 contemplates utilization of a different form of index marks on the label strip. More particularly, FIG. 16 depicts the provision of uniformly spaced index marks 330 and 332 respectively carried by the carrier strip portions 320 and 322. The index marks 330 and 332 can be of various types as long as their physical characteristics can be readily recognized. Thus, the index marks can comprise small points on the label strip having different physical characteristics (e.g. magnetic, electrical, optical, structural) than the remainder of the strips so that they can be recognized by a suitable sensing device. Indeed, the index marks can comprise specific portions of the labels themselves.

The apparatus of FIG. 16 further includes first and second index mark sensors 336 and 338 positioned adjacent the paths of the carrier strip portions 320 and 322 downpath from the V-shaped region 304. The index mark sensors 336 and 338 respond to the index marks moving therepast and control (e.g. electrically or pneumatically) the operation of the clutch assemblies 324 and 326 respectively. Thus, with the assumption that the index marks are correspondingly placed on the two carrier strip portions, the system depicted in FIG. 16 will assure that the carrier strip portions are advanced by the same amount because for each step of the label strip, each clutch assembly will remain engaged until its associated sensor recognizes the movement of a predetermined number of index marks therepast (which number can be one or more).

In order to better understand the operation of the embodiment of FIG. 16 attention is directed to the control circuit block diagram of FIG. 17. FIG. 17 illustrates the sensors 336 and 338 and clutch assemblies 324 and 326 of FIG. 16. It has been assumed that the clutch assemblies 324 and 326 are each provided with respective ENGAGE and DISENGAGE input terminals. A timing control means 348 is provided which periodically provides an ENGAGE command signal to the clutch assemblies 324 and 326 to thus cause the drive rollers 316 and 318 to rotate thereby pulling the carrier strip portions around the guide roller 312, past the drag means 314, and around the edge of the V-shaped region 304. The sensors 336 and 338 independently sense the index marks on the character strip portions 320 and 322 and provide a DISENGAGE command signal to the clutch assemblies when the predetermined number of index marks is recognized.

FIG. 17 depicts first and second counters 350 and 352 in phantom to indicate that the use of these counters is optional. Consider first the control circuitry of FIG. 17 in the absence of the counters 350 and 352 with the output of the sensors 336 and 338 coupled directly to the DISENGAGE control terminals of the clutch assemblies. Also initially consider that the label strip depicted in FIG. 16 carries only one index mark per label. In such a simple system, both clutch assemblies 324 and 326 will remain engaged until an index mark moves past its associated sensor. Thus, even if the respective clutch assemblies or their associated drive rollers drive the respective carrier strip portions at slightly different rates, e.g. due to slippage, nevertheless the respective carrier strip portions will be moved by equal linear increments because the clutch assemblies can remain engaged for differing durations necessary to move its associated carrier strip portion by a predetermined distance. In a more complex system, multiple index marks can be provided along the label strip for each label in order to effect more precise control of the carrier strip portions. Thus for example, one hundred index marks could be provided on each of the carrier strip portions between successive label positions. In such a system utilizing multiple index marks per label position, counters 350 and 352 would be provided to count the passage of the hundred index marks and the counter would independently apply DISENGAGE control signals to the respective clutch assemblies 324 and 326 only after each had counted one hundred index marks. The ENGAGE command signal supplied by the timing control means 348 is used to zero the counters. Moreover, the states of the counters 350 and 352 could be supplied to a timing control circuit associated with the label applicator, e.g. bellows, in systems where it is more desirable to electrically control the applicator rather than mechanically, as has been described in connection with FIGS. 1–15.

Figure 19:
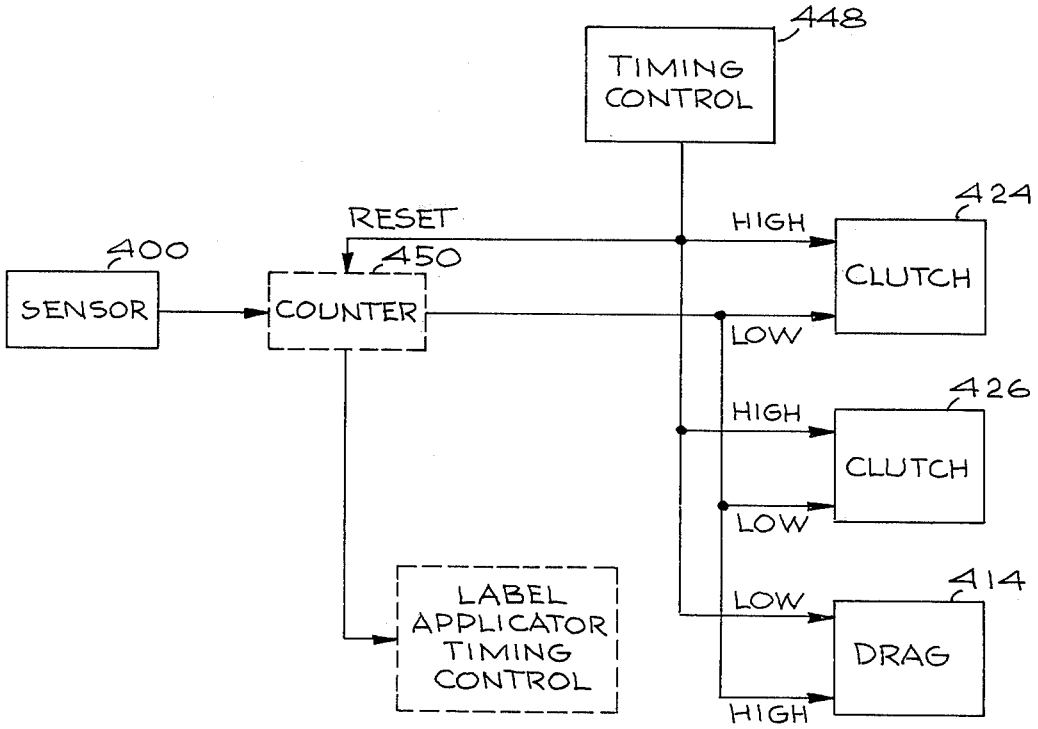
FIG. 19 is a block diagram of a control circuit usable with the apparatus of FIG. 18.
Figure 18:
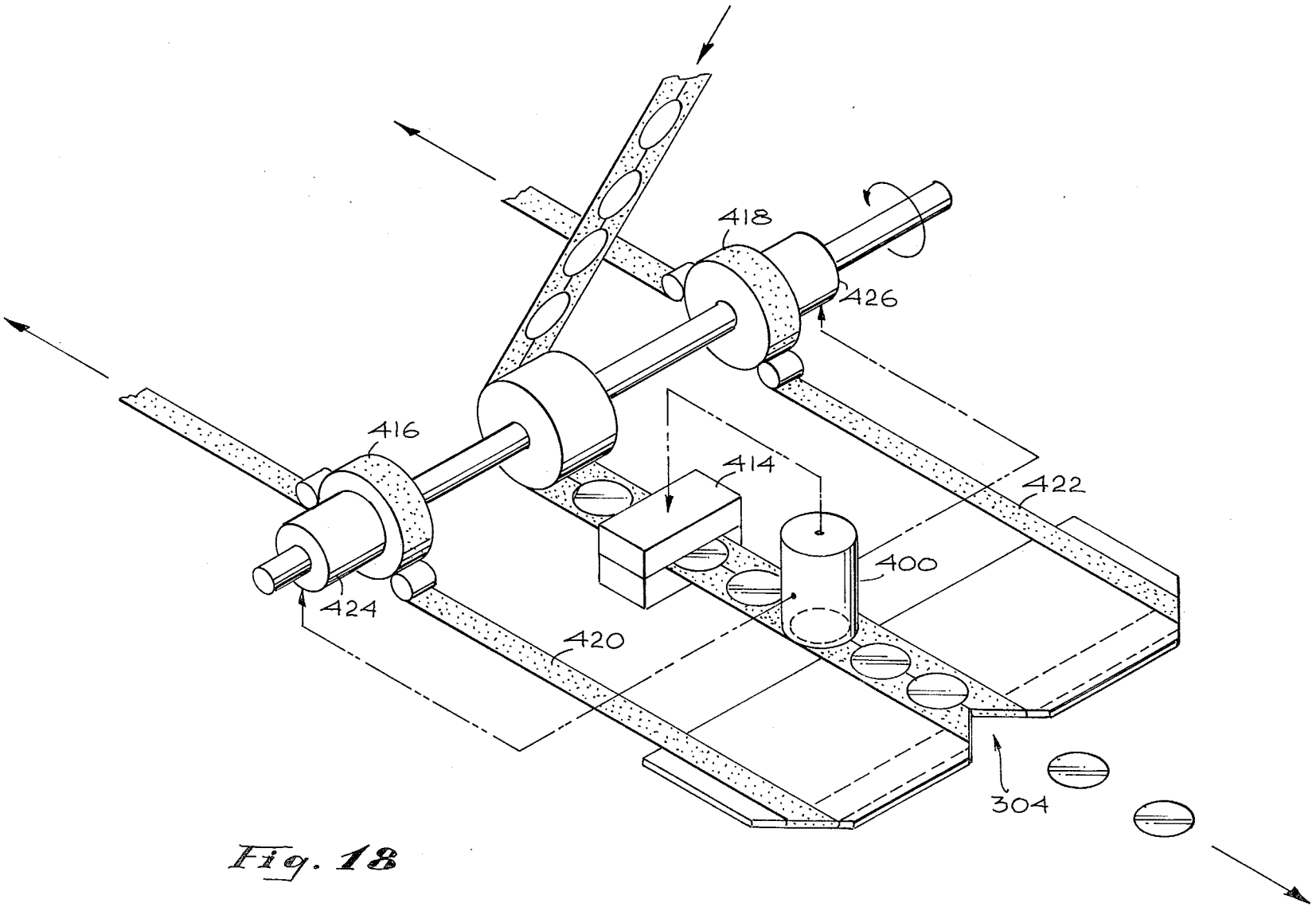
FIG. 18 is a perspective view of a further alternate embodiment of the present invention.

Attention is now directed FIG. 18 which illustrates a second alternative embodiment which is similar in construction to the embodiment of FIG. 16 except however that in lieu of utilizing separate index mark sensors downpath from the V-shaped region 304, the embodiment of FIG. 18 utilizes a single index mark sensor 400 located up-path from the V-shaped region 304. In the embodiment of FIG. 18, the sensor 400 not only controls the clutch assemblies 424 and 426 but additionally controls an actuable drag means 414. In the operation of FIG. 18, when the up-path sensor 400 observes the passage of a predetermined number of index marks (which could be one or a multiple number), the drag introduced by drag means 414 and/or the torque transmitted by clutch assemblies 424 and 426 is modified so that the torque is insufficient to overcome the drag, but sufficient to pull out any slack present in either carrier strip portions. After both carrier strip portions have become equally taut, both clutch assemblies will slip. FIG. 19 illustrates a block diagram of the control circuit associated with the embodiment of FIG. 18 and it will be apparent that it is essentially similar in structure and operation to the control circuit depicted in FIG. 17, previously described.

More particularly, FIG. 19 depicts sensor 400 which is connected to optional counter 450 (shown in phantom). The output of sensor 400 (or counter 450, if included) is coupled to the LOW torque control terminals of clutch assemblies 424, 426 and HIGH drag control terminal of drag means 414. The output of a timing control means 448 is coupled to the HIGH torque control terminals of clutch assemblies 424, 426, and LOW drag control terminal of drag means 414.

When the timing control means provides an initiating signal, clutch assemblies 424 and 426 cause drive rollers 416, 418 to pull carrier strip portions 420, 422 against the restraint of drag means 414. After sensor 400 has detected a index mark (or counter 450 counted a predetermined multiple number of index marks), the torque introduced by drive rollers 416, 418 is reduced while the drag force exerted by drag means 414 is increased so that although the forward motion of the label strip as a whole is arrested, the torque is sufficient to pull out slack from either carrier strip.

The embodiments of FIGS. 16 and 18 have both been depicted as including drive rollers located downpath from the V-shaped region which frictionally engage the carrier strip portions. It is pointed out however that it is not intended to so limit these embodiments and indeed the embodiments of FIGS. 16 and 18 could utilize sprocket holes and sprocketed rollers for transporting the carrier strip portions. The significant characteristic of FIGS. 16 and 18 which distinguishes it from the apparatus previously disclosed is the use of index marks other than sprocket holes which can be readily sensed by appropriate magnetic, electrical, or optical sensors.

Although particular embodiments of the invention have been described as illustrated herein, it is recognized that modifications and variations may readily occur to those skilled in the art and consequently it is intended that the claims be interpreted to cover such modifications and equivalents.

I claim:

1. Apparatus for automatically sequentially applying labels to objects, said apparatus comprising:

a label strip having index marks therealong separated from one another by a unit spacing, said label strip including first and second parallel carrier strip portions and a plurality of labels adhered along said strip so as to bridge said carrier strip portions, each label being uniformly positioned with respect to one of said index marks;

a plate having first and second opposing surfaces and an edge including a label separation region extending into said plate comprised of first and second edge portions having non-aligned axes;

strip transport means for moving said label strip along a first path extending substantially contiguous with said first surface toward said label separation region and then along first and second branch paths respectively extending around said first and second edge portions and thence along said second surface;

said strip transport means including (1) first means positioned down-path from said first and second edge portions engaging both said first and second carrier strip portions for pulling them along said first and second branch paths at a substantially first linear rate and (2) second means positioned up-path from said label separation region in engagement with said carrier strip portions tending to reduce their rate of movement to less than said first linear rate thus creating tension in said carrier strip portions and (3) means associated with said first and/or second means and operatively coupled to said index marks for moving said first and second carrier strip portions by identical multiples of said unit spacing to thus prevent any cumulative differential linear movement between said carrier strip portions; and label-applying means operable to engage labels immediately adjacent to said label separation region as said carrier strip portions are simultaneously separated from each other and from said labels and to press said engaged labels against objects to be labeled.

2. The apparatus of claim 1 wherein said means operatively coupled to said index marks includes first and second sensors located down-path from said first and second edge portions for sensing index marks on said first and second carrier strip portions moving therepast; and wherein said first means of said strip transport means includes first and second drive means respectively responsve to said first and second sensors for separately pulling said first and second carrier strip portions.

3. The apparatus of claim 1 wherein said means operatively coupled to said index marks includes a sensor located up-path from said first and second edge portions for sensing the movement of index marks therepast; and wherein said first means of said strip transport means includes first and/or second means responsive to said sensor for modifying the pulling force of said first means relative to the drag force exerted by said second means.

4. The apparatus of claim 3 wherein said first means of said strip transport means includes first and second drive means responsive to said sensor for separately pulling said first and second carrier strip portions.

5. The apparatus of claim 1 wherein said index marks comprise portions of said labels.

6. The apparatus of claim 1 wherein first and second plate surfaces are substantially planar surfaces.

7. The apparatus of claim 6 wherein the edge of the plate including the label separation region lies substantially in plane of said plate.

8. The apparatus of claim 1 wherein the axes of the separation edges substantially intersect one another to form a V-shaped region.

9. The apparatus of claim 1 wherein the axes of the separation edges are substantially parallel to one another but spaced apart from one another along the path of the labels.

10. Apparatus for use with a label strip having index marks spaced therealong separated from one another by a unit spacing, said label strip including first and second parallel carrier strip portions and a plurality of labels adhered therealong so as to bridge said carrier strip portions, each label being uniformly positioned with respect to one of said index marks, said apparatus automatically sequentially removing labels from said strip and applying them to objects, said apparatus comprising:

a plate having first and second opposing surfaces and an edge including a label separation region extending into said plate comprised of first and second edge portions having non-aligned axes;

strip transport means for moving said label strip along a first path extending substantially contiguous with said first surface toward said label separation region and then along first and second branch paths respectively extending around said first and second edge portions and thence along said second surface;

said strip transport means including (1) first means positioned down-path from said first and second edge portions engaging both said first and second carrier strip portions for pulling them along said first and second branch paths at a substantially first linear rate and (2) second means positioned up-path from said label separation region in engagement with said carrier strip portions tending to reduce their rate of movement to less than said first linear rate thus creating tension in said carrier strip portions and (3) means associated with said first and/or second means and operatively coupled to said index marks for moving said first and second carrier strip portions by identical multiples of said unit spacing to thus prevent any cumulative differential linear movement between said carrier strip portions; and label applying means operable to engage labels immediately adjacent to said label separation region as said carrier strip portions are simultaneously separated from each other and from said labels and to press said engaged labels against objects to be labeled.

11. The apparatus of claim 10 wherein said means operatively coupled to said index marks includes first and second sensors located down-path from said first and second edge portions for sensing index marks on said first and second carrier strip portions moving therepast; and wherein said first means of said strip transport means includes first and second drive means respectively responsive to said first and second sensors for separately pulling said first and second carrier strip portions.

12. The apparatus of claim 10 wherein said means operatively coupled to said index marks includes a sensor located up-path from said first and second edge portions for sensing the movement of index marks therepast; and wherein said first means of said strip transport means includes first and/or second means responsive to said sensor for modifying the pulling force of said first means relative to the drag force exerted by said second means.

13. The apparatus of claim 12 wherein said first means of said strip transport means includes first and second drive means responsive to said sensor for separately pulling said first and second carrier strip portions.

14. The apparatus of claim 10 wherein the said index marks comprise portions of said labels.

15. The apparatus of claim 10 wherein said first and second plate surfaces are substantially planar surfaces.

16. The apparatus of claim 15 wherein the edge of the plate including the label separation region lies substantially in the plane of said plate.

17. Apparatus of claim 10 wherein the axes of the separation edges substantially intersect one another to form a V-shaped region.

18. The apparatus of claim 10 wherein the axes of the separation edges are substantially parallel to one another but spaced apart from one another along the path of the labels.

* * * * *